United States Patent [19]

Heilhecker et al.

[11] Patent Number: 4,485,697

[45] Date of Patent: Dec. 4, 1984

[54] KELLY SPINNER

[75] Inventors: Joe K. Heilhecker, Houston; James D. Rodgers, Cypress; Steven C. Gaare, Humble, all of Tex.

[73] Assignee: Foster Cathead Company, Wichita Falls, Tex.

[21] Appl. No.: 490,064

[22] Filed: Apr. 29, 1983

[51] Int. Cl.[3] ..... B25B 17/00

[52] U.S. Cl. ..... 81/57.2

[58] Field of Search ..... 81/57.2, 57.15, 57.18, 81/57.21

[56] References Cited

U.S. PATENT DOCUMENTS 3,261,241 7/1966 Catland ..... 81/57.18

4,273,010 6/1981 Farr et al. ..... 81/57.2

*Primary Examiner*—James L. Jones, Jr.

*Attorney, Agent, or Firm*—Vinson & Elkins

[57] ABSTRACT

A kelly spinner rotatable in opposite directions in which means are provided for preventing engagement of the jaws of the spinner with the pipe when rotated in one direction by a stop which may be removed by the operator to permit the jaws to engage when rotated in said direction.

6 Claims, 8 Drawing Figures

FIG. 2
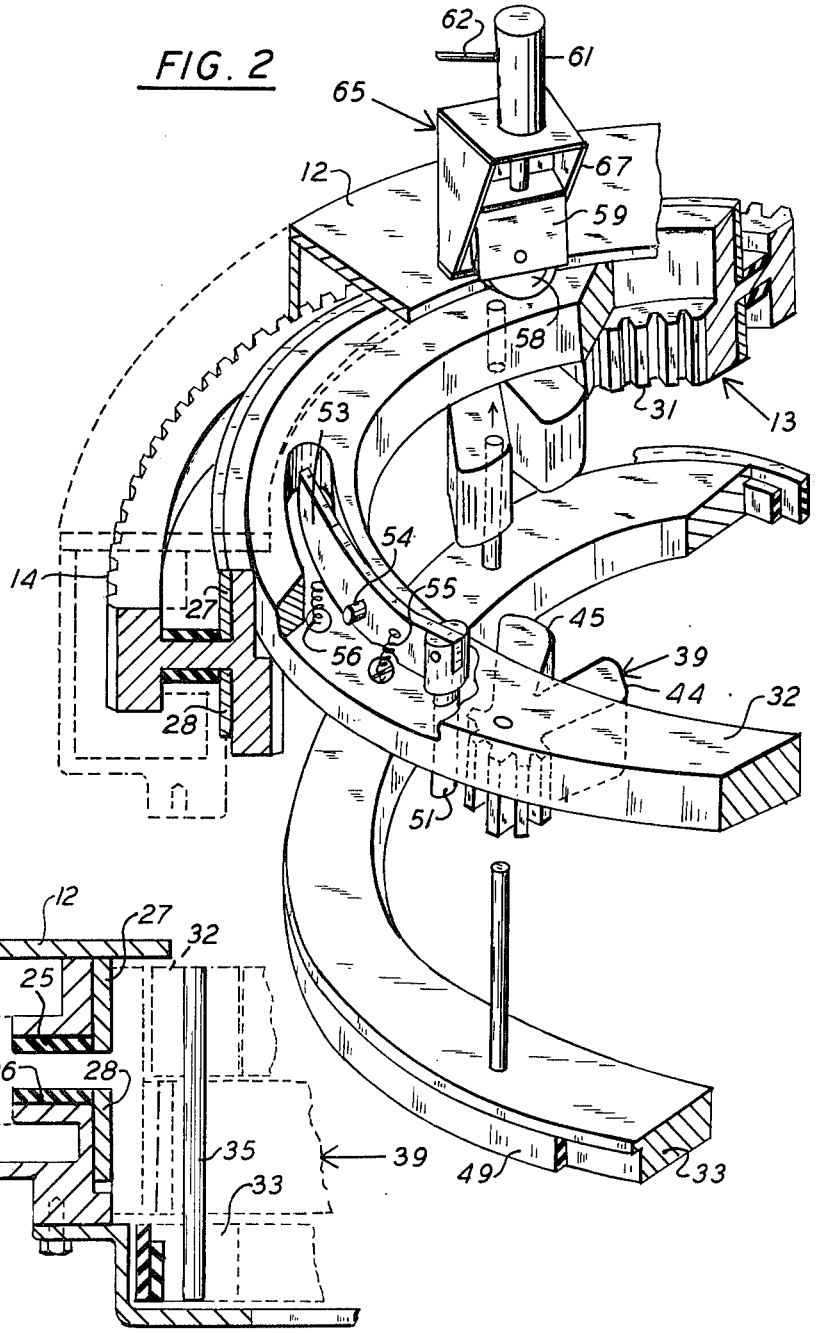
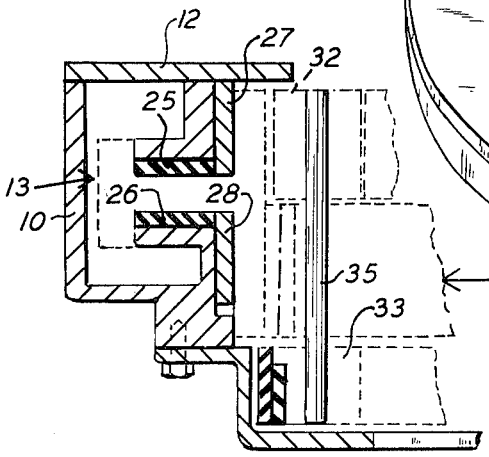
FIG. 3

KELLY SPINNER

This invention relates to a reversible kelly spinner.

Reversible kelly spinners have been used to connect and disconnect pipe on drilling rigs as a substitute for the spinning chain with its known dangers.

Known kelly spinners have the disadvantage of being costly, too large, and too heavy. They are also subject to problems induced by the reversing feature. For instance, one design incorporates an idler gear which is meshed continuously to a drive gear. By use of a small cylinder, the idler gear is rotated around the drive gear until it engages the final drive gear. The potential for gear tooth problems exists due to incorrect gear tooth mesh. Another design uses an air clutch to engage and disengage the reversible feature.

It would be advantageous to simply be able to rotate two groups of teeth into engagement with the pipe to be spun on rotation of the final drive gear in opposite directions.

The problem arises, however, that when making up pipe with the kelly the make up jaws firmly engage the driven pipe. To disengage the make up set of jaws by reversal of the spinning motor would cause engagement of the break out set of jaws which cannot be permitted. Engagement of the break out jaws might unthread the joint. Additionally, the string in the well is sometimes wound up along its length due to frictional engagement with the hole. If the kelly spinner jaws are not released, sudden release of the wound up pipe will cause the kelly spinner to rotate with possible damage to the kelly spinner hose or the mud line. Thus, a kelly spinner of simple design in which the final drive gear is rotated in opposite directions to control the pipe engaging jaws must permit limited rotation in a direction to release the make up jaws, but not be permitted to rotate a sufficient distance to engage the break out jaws except at the express command of the operator.

It is an object of this invention to provide a kelly spinner of the direct drive type, as discussed above, in which the kelly spinner may be reversed to release the make up jaws and after such release the break out jaws are prevented from engaging the spun pipe, except upon express command of the operator so that the break out jaws will not be accidentally engaged during release of the make up jaws.

Another object is to provide a kelly spinner of the type discussed above in which release of the make up jaws from the driven pipe by rotation of the final drive gear will not result in engagement of the break out jaws, except upon express command of the operator.

Another object is to provide a relatively light, small and inexpensive reversible kelly spinner in which all gear teeth are always engaged and the reversing feature is provided by rotating the final drive gear in opposite directions with a reversing motor in which a releasable stop is provided to prevent engagement of the reversing pipe engaging faces on the jaws during release of the drive jaw pipe engaging faces from the driven pipe.

Another object is to provide a reversing kelly spinner in which a stop is positioned to prevent engagement of the reversing jaws during normal make up operations, which stop may be moved to an out of the way position when the operator wishes to break out pipe.

Another object is to provide a kelly spinner, as in the preceding object, in which the stop rotates with the jaw assembly and is moved to the disengaged position by extension of an actuator mounted on the housing which as the jaw assembly rotates, engages and effects movement of the stop to its release position.

Other objects, features and advantages of the invention will appear from the specification, the drawings and the claims.

In the drawings wherein an illustrative embodiment of this invention is shown and wherein like reference numerals indicate like parts:

FIG. 2 is a schematic fragmentary partially exploded view of the kelly spinner;

FIG. 3 is a fragmentary sectional view through the kelly spinner with parts of the equipment shown in phantom;

Figure 1:
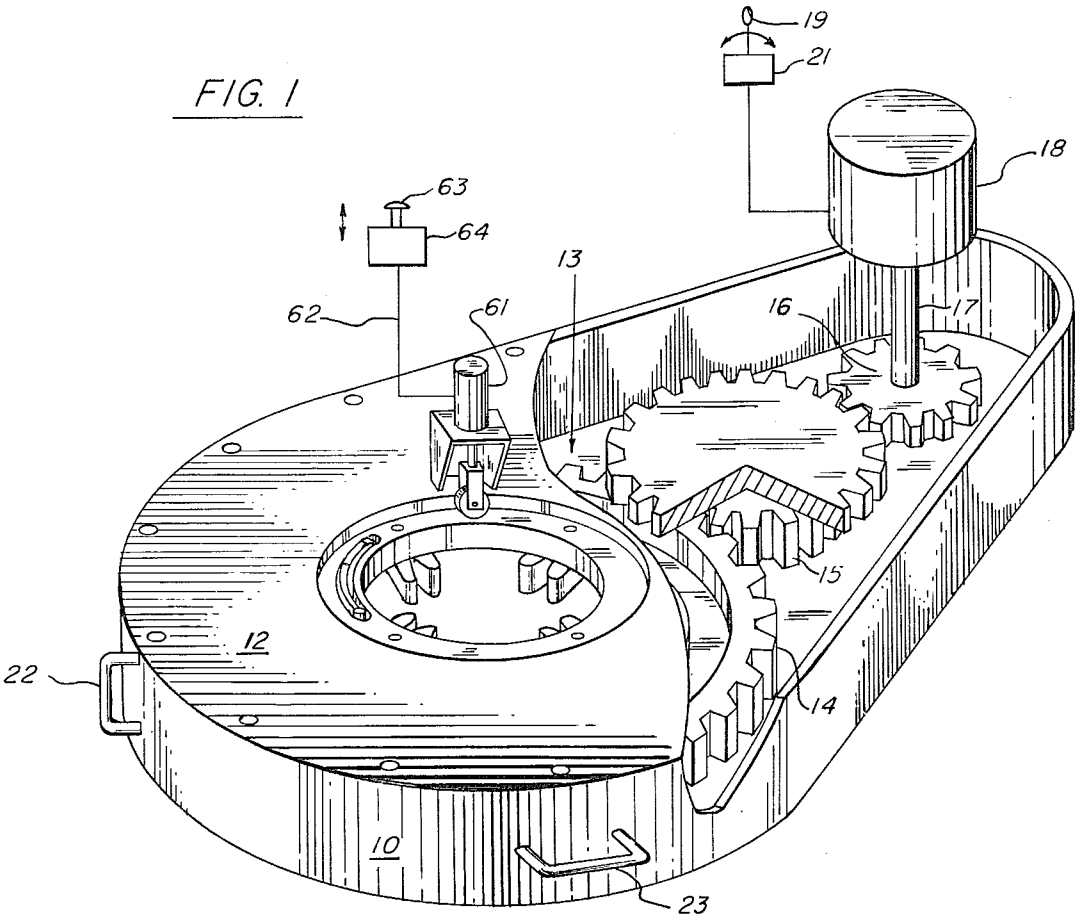
FIG. 1 is a schematic view of a kelly spinner constructed in accordance with this invention with a portion of the upper housing broken away to illustrate details.

The kelly spinner includes an outer housing 10, a lower housing cover 11, and an upper housing cover 12. The three elements of the housing generally enclose the kelly spinner leaving an annular opening therein in the conventional manner.

Within the housing there is mounted an annular final drive gear, indicated generally at 13. The final drive gear 13 has on its outer diameter a rack 14 driven by the gear 15, which is in turn driven by the gear 16 mounted on the arbor 17 of the reversing motor 18. Preferably, the reversing motor is hydraulic and drives in either direction in response to movement of the control handle 19 on the control box 21 for supplying hydraulic fluid to the motor to drive it in opposite directions in the conventional manner.

The housing is provided with suspending ears, two of which are shown at 22 and 23 to suspend the kelly spinner from the rotary swivel of a drilling rig in the conventional manner.

The final drive gear 13 is H-shaped in cross-section and the horizontally extending portion 24 of the final drive is supported from above by a bearing 25 and from below by a bearing 26. These bearings may take any desired form, such as solid rings of phenolic material. The final drive is also supported by bearings 27 and 28 which bear against the exterior surface of the inner flange 29 of the final drive. These bearings may also take any desired form, such as roller bearings.

The lower inner diameter portion of the final drive gear 13 is provided with the annular rack means 31. As will appear hereinafter, this lower rack 31 drives pipe engaging jaws which are arranged symmetrically, such as at four equally spaced points, and thus all of the teeth of the rack will not be operative, but it is preferred to utilize a continuous rack and during the life of the spinner to be able to change the teeth on the rack which are utilized, if desired.

A pipe engaging assembly is provided which is rotatable relative to the final drive gear 13.

The pipe engaging assembly includes the upper ring 32 and the lower ring 33. Preferably, the final drive 13 has an enlarged upper inner diameter section providing a step 34 on which the upper ring 32 rests.

The two rings 32 and 33 are secured to each other in spaced relationship by a plurality of pins 35, 36, 37 and 38. Additional pins may be utilized, if desired.

A plurality of pipe engaging jaws, indicated generally at 39, 41, 42 and 43, are supported on the pins 35, 36, 37 and 38, respectively, for rotation about said pins.

The several jaws provide two groups of pipe engaging faces. Each of the jaws illustrated has one pipe engaging face of each group thereon so that with rotation of the assembly in one direction one pipe engaging face of each jaw engages a pipe and upon rotation in the other direction the other pipe engaging face of each jaw engages a pipe. It will be appreciated that while jaws having double pipe engaging surfaces in a generally V-shaped configuration are illustrated, separate jaws could be provided for each pipe engaging face. For instance, eight circumferentially spaced jaws could be substituted for the four illustrated and four of the eight would be utilized in rotating a pipe in one direction and the other four would be utilized in rotating a pipe in the other direction.

Each of the jaws 39 through 43 is V-shaped in configuration and has a pipe engaging face 44 at the extremity of one leg of the V and a pipe engaging face 45 at the extremity of the other leg of the V.

To couple the jaws to the final drive, each jaw is provided with a segment of gear engaging teeth 46 which mesh with the internal rack 31 of the final drive 13. Thus, rotation of the final drive 13 rotates each of the jaws about its supporting pin and moves the pipe engaging faces 44 or 45 between a relatively large diameter circle in which they do not engage a pipe extending through the spinner and a relatively smaller diameter circle in which they engage a pipe extending through the spinner. Of course, reverse rotation of the final drive 13 effects the reverse action and the other group of pipe engaging faces is moved between a relatively large and relatively small diameter circle to move from non-engaging to engaging position to engage a pipe in the spinner.

Thus, the pipe engaging faces 44 and 45 of the several jaws alternately move from a first position in which the faces define a relatively large circle and a second position in which the faces define a relatively small circle and in so moving engage and disengage a pipe in the spinner to rotate it in the desired direction.

The pipe engaging assembly is rotatable relative to the final drive 13 and to insure that the several jaws rotate into engagement or disengagement with a pipe the assembly is provided with a friction means between the assembly and housing which resists rotation of the assembly in the housing.

For this purpose the lower ring 33 carries a steel band 47 having in-turned ends 47*a* and 47*b*. The ring 33 has a groove 48 extending vertically therein which receives the ends 47*a* and 47*b* and the side walls of the groove, not shown, are engaged by the ends of the ring 47 to limit the rotation of the friction band 47 on the lower ring 33. The band 47 bears against a friction member 49 carried in the lower housing 11. This member 49 may be a phenolic or asbestos type ring to be engaged by the steel band 47 and frictionally resist rotation of the pipe engaging assembly in the conventional manner and insure that with initial rotation of the final drive gear 13 the several jaws will be rotated in the appropriate direction and thereafter the pipe engaging assembly will rotate with the final drive gear.

When the kelly spinner is utilized to make up pipe the jaws will be in firm gripping relationship with a pipe in the spinner at the end of the make up operation. To release the jaws, the final drive 13 is rotated in the reverse direction. Means should be provided, however, to prevent this reverse rotation from resulting in the other pipe engaging faces of the jaws engaging the pipe and unscrewing the pipe or possibly inducing a release of a torque wound pipe which might result in damage to the kelly spinner or to the rotary swivel from which the spinner is hung.

Means are provided which will permit the several jaws to move far enough to disengage a pipe, but will stop rotation of the jaws to a point at which the other pipe engaging faces will engage the pipe and tend to back it out of its threaded engagement with a pipe hung in the rotary table. For this purpose, a stop means is provided which limits the relative rotation between the pipe engaging assembly and the final drive. In the preferred form illustrated, the stop means acts with one of the jaws to limit its rotation and as all of the jaws are in a locked-in geared relationship with the final drive rack 31, all of the jaws are held against such rotation. For this purpose it will be noted that the arc of the gears on each of the jaws is such that it cannot disengage the rack 31, and this permits the use of a single stop acting on a single jaw to be effective on all of the jaws. Of course, stops could be provided for all of the jaws, if desired, or in the alternative the stop could cooperate directly between the upper or lower ring and the final drive.

Figure 4:
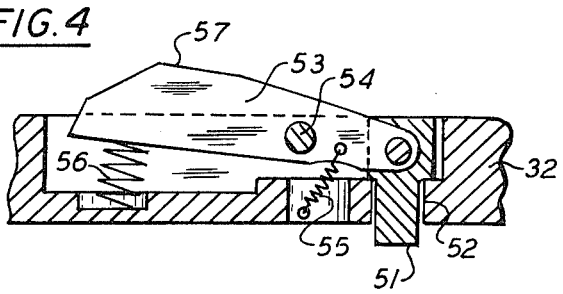
FIG. 4 is a fragmentary view in section through the upper ring of the pipe engaging assembly.
Figure 5:
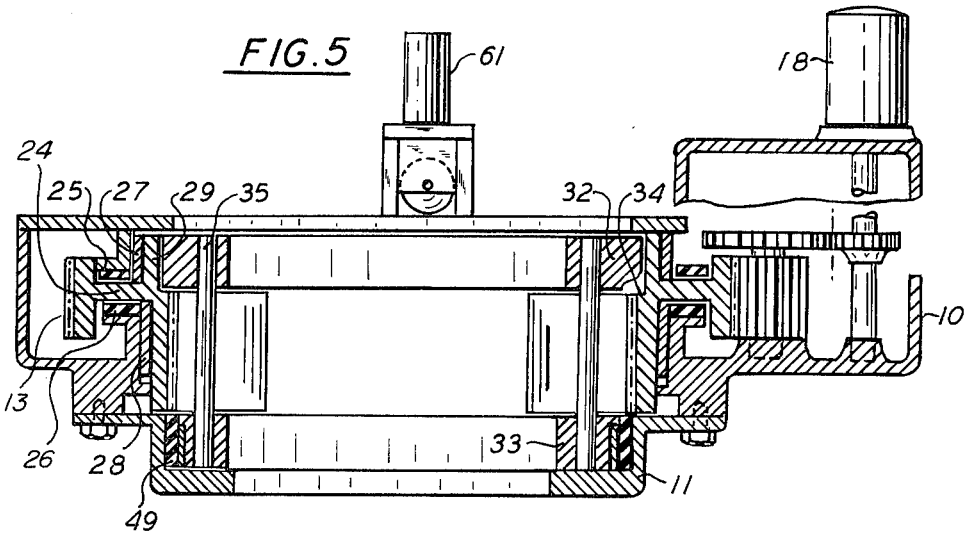
FIG. 5 is a cross-sectional view through the kelly spinner.
Figure 6A:
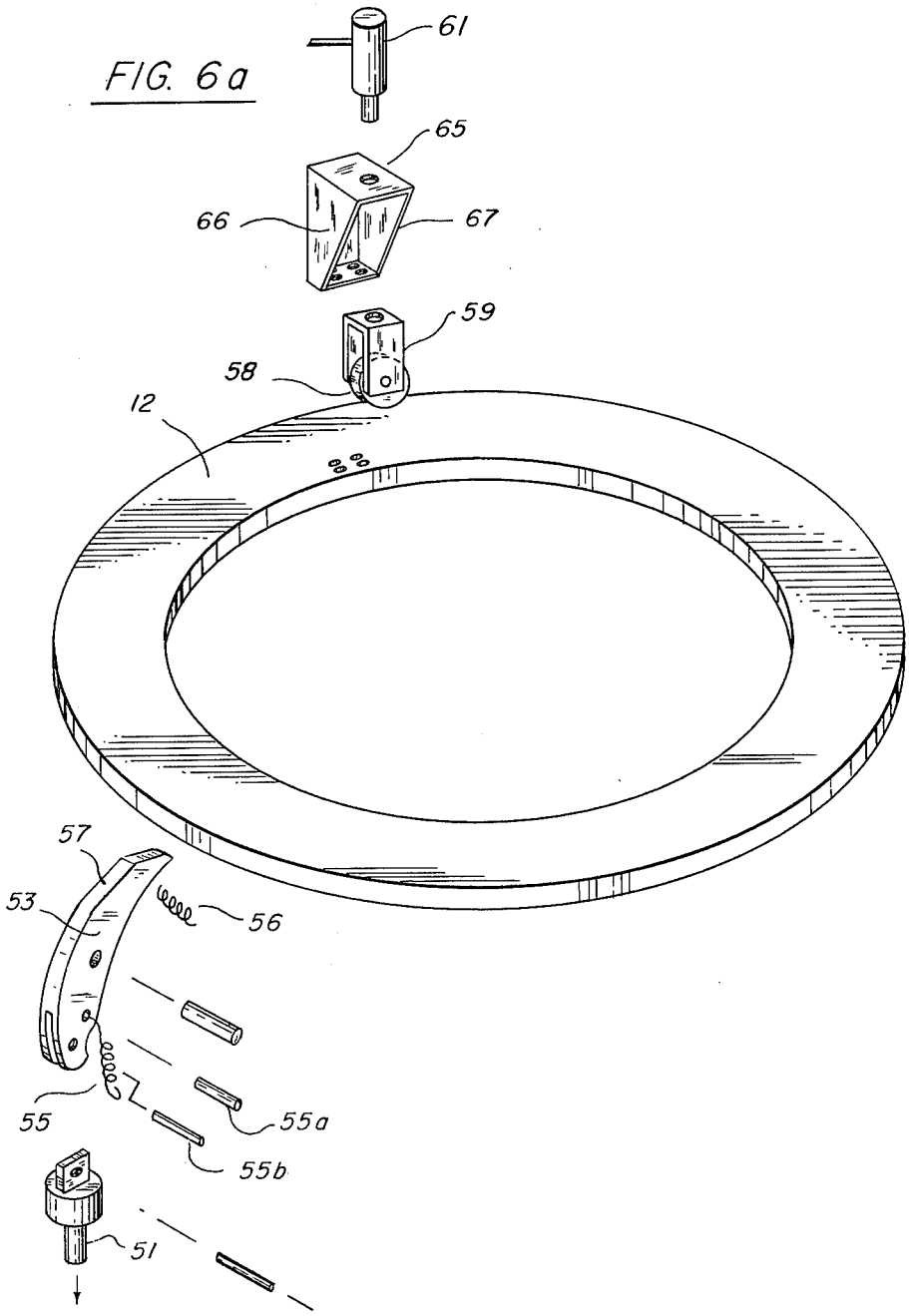
FIG. 6A, 6B and 6C are exploded continuation views illustrating in FIG. 6A a fragment of the upper cover and an actuator, together with the stop means and its actuator arm; and in 6B the upper ring which carries the stop and actuator, together with the pipe engaging means and their supporting pins; and in 6C the final drive gear and the lower ring and part of the brake means.
Figure 6B:
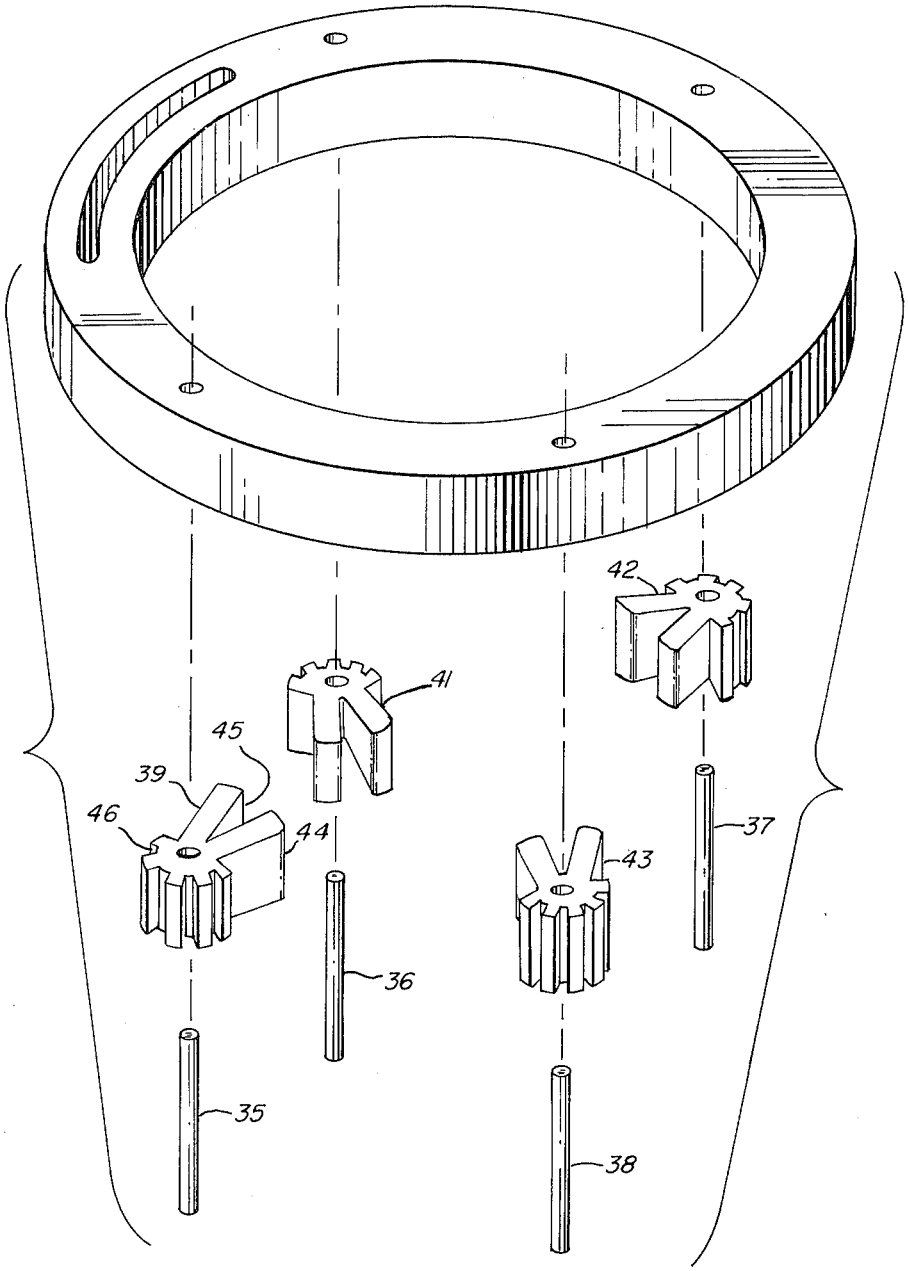
Figure 6C:
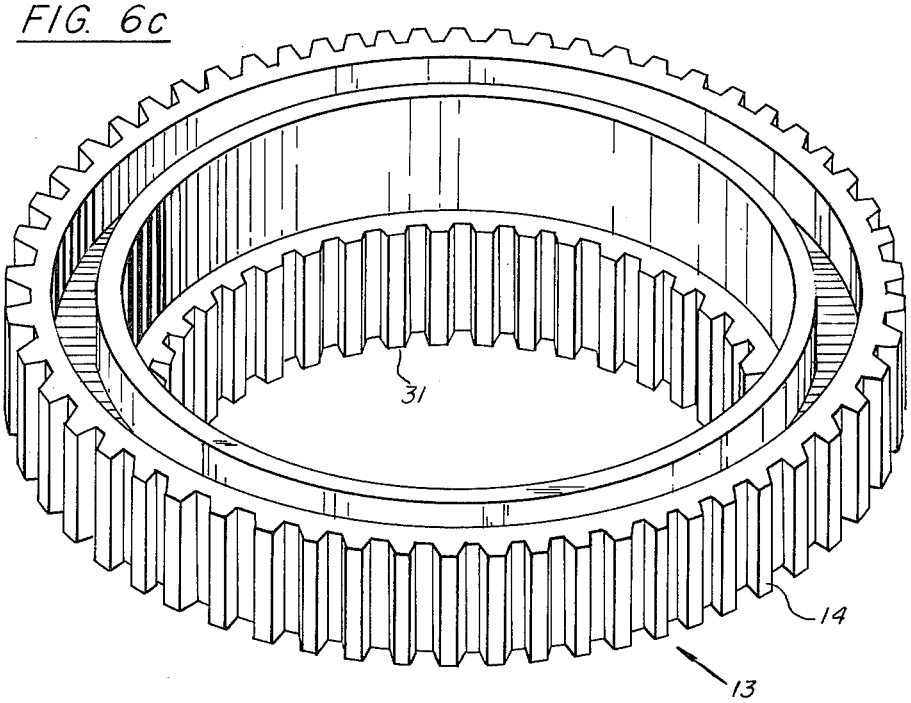
Figure 6C:
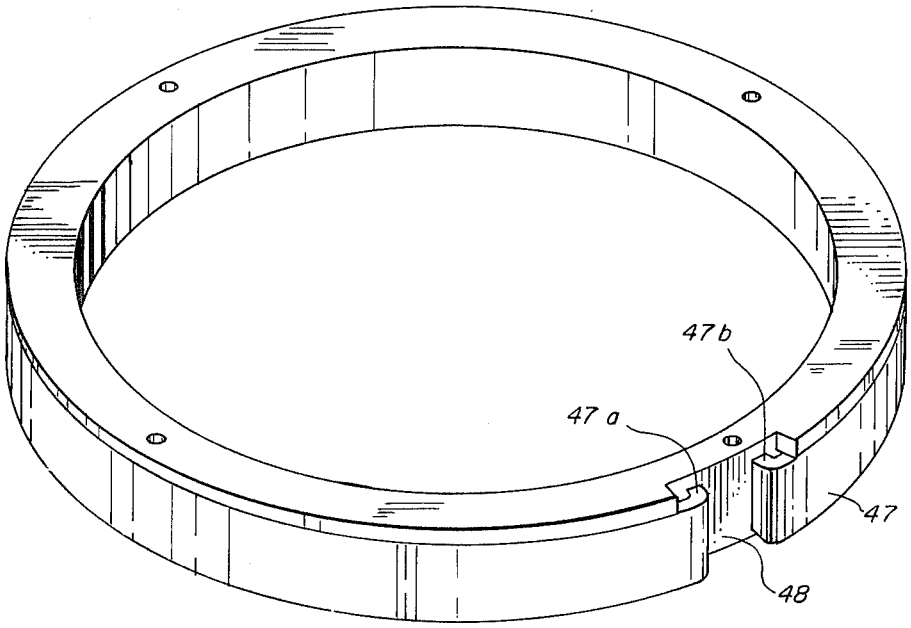

As best shown in FIGS. 2 and 4, a pin 51 projects downwardly through a hole 52 in the upper ring 32. As shown best in FIG. 2, when this pin 51 is in the down or projecting stop position the jaw 39 may rotate through a small arc to disengage a pipe but will then strike the projected pin and be limited in rotation such that the pipe engaging face 44 will not rotate inwardly a sufficient distance to engage a pipe in the spinner.

The stop pin 51 is mounted on a rock arm 53 pivoted about pin 54. A tension spring 55 extends between pins 55*a* on the rock arm and pin 55b carried by the upper ring 32 to resiliently urge the stop pin 51 downwardly into a blocking position. In like manner, a compression spring 56 extends between the rock arm 53 and the upper ring 32 and also urges the pin 51 downwardly. Two springs are provided so that in the event of failure of one spring the other spring will provide the desired action until the broken spring is discovered and replaced.

Rotation of the rock arm 53 about its pivot 54 in a counterclockwise direction, as viewed in FIG. 4, will raise the pin 51 up and position it at least as high as the bottom surface of the ring 32. When this occurs the jaw 39 is free to rotate to a position underlying the stop 51. Thus, when the stop means is moved to its release position it releases the jaw 39 and all jaws are permitted to rotate to a pipe engaging position. As the jaw 39 passes under the stop 51, the stop will be held in release position until rotation of the final drive in the make up direction, which will rotate the jaw 39 out from under the stop and permit the springs to return the stop 51 to its blocking position.

Thus, the rock arm 53 and the resilient means provided by the two springs provide a means for selectively moving the pin 51 to its blocking position.

Means are also provided for moving the pin 51 to its release position. Such means includes the ramp provided by the upper surface 57 of the rock arm 53 being engaged by a selectively operated depressor as the system is rotated in the pipe unthreading mode.

Such a means is provided by a roller 58 carried in yoke 59 which is reciprocated by the hydraulic cylinder or the motor 61. Preferably the motor 61 provides for movement in one direction by a resilient means, such as a spring within the motor and movement in the other direction in response to control of fluid directed to the motor 61 through the line 62 in response to pressing the control button 63 of control unit 64.

The motor 61 is mounted on the guide housing, indicated generally at 65, which has opposed walls 66 and 67 in sliding engagement with the yoke 59 to support the yoke when the wheel 58 is extended to engage the ramp 57 on the rock arm 53. Thus, when the driller wishes to make up pipe he utilizes only the control arm 19 to rotate the final drive 13 in opposite directions to move the pipe engaging faces 45 of each jaw between pipe engaging and pipe releasing position. When the driller wishes to unscrew a stand of pipe, he utilizes the control 19 and additionally depresses the button 63 to extend the wheel 58. As the final drive rotates the pipe engaging system under the wheel 58, the wheel will engage the ramp 57 depressing the free end of the rock arm 53 and withdrawing the stop pin 51 to its release position, at which time the several jaws may rotate to engage the pipe with the pipe engaging faces 44 to break out a stand of pipe.

In operation the kelly spinner will be suspended immediately below the rotary swivel of a conventional drilling rig. A short length of pipe will depend from the rotary swivel and extend downwardly below the kelly spinner. A conventional kelly will be made up in the short length of pipe and the kelly will be used to pick up a new stand of pipe from the rathole and thread the new stand of pipe into the string suspended in the rotary table of the well. The kelly spinner of this invention may be utilized to spin the kelly into the stand of pipe in the rathole and after the kelly has suspended the pipe above the string extended into the well the kelly spinner may again be utilized to make up the joint between the new stand of pipe and the string suspended in the rotary table. Then the kelly spinner will be operated in the reverse mode to release the kelly from the stand of pipe. The driller may insure that the kelly releases from the stand of pipe by holding the stand with tongs or tonging the stand into the string prior to releasing the kelly from the stand.

During the release operation the kelly spinner is operated in the reverse mode with the stop means 51 extended so that the jaws cannot rotate into a position where they would engage the pipe and tend to rotate it in a reverse mode.

When it is desired to utilize the kelly spinner to unscrew pipe the operator merely depresses the control button 63 at the same time he is utilizing the control arm 19 to rotate the final drive and as the ramp of the arm 53 moves under the wheel 58 which is now extended downwardly, the arm is rocked about its pivot 54 to move the stop to retracted or release position and the jaw 39 moves under the stop 51 and holds it in its retracted position while the jaw rotates to bring the pipe engaging faces 44 into engagement with the pipe to rotate it in the break out direction.

The foregoing disclosure and description of the invention is illustrative and explanatory thereof and the various changes in the size, shape and materials, as well as in the details of the illustrated construction, may be made within the scope of the appended claims without departing from the spirit of the invention.

What is claimed is:

1. A kelly spinner comprising:

a housing;

an annular final drive gear having annular rack means in said housing;

means for rotating said final drive gear in opposite directions;

a pipe engaging assembly rotatable relative to said final drive gear;

said assembly including a plurality of circumferentially arranged jaws having pipe engaging faces mounted for rotation between a first position in which said faces define a relatively large circle and a second position in which said faces define a relatively small circle;

said jaws each having teeth meshing with teeth on said rack means;

friction means between said assembly and housing resisting rotation of said assembly in said housing;

stop means movable between a blocking position permitting limited rotation of said jaws from said second position and blocking rotation of said jaws to said first position during rotation of said final drive gear in one direction and a release position permitting said jaws to rotate to said second position upon said rotation of said final drive gear in said one direction; and means for selectively moving said stop means between said blocking and release positions.

2. A kelly spinner comprising:

a housing;

an annular final drive gear having annular rack means in said housing;

means for rotating said final drive gear in opposite directions;

a pipe engaging assembly rotatable relative to said final drive gear;

said assembly including two groups of circumferentially arranged jaws having pipe engaging faces and teeth meshing with teeth on said rack means;

said jaws mounted for alternate rotation between a first position in which said faces define a relatively large circle and a second position in which said faces define a relatively small circle upon rotation of said final drive gear in opposite directions;

friction means between said assembly and housing resisting rotation of said assembly in said housing;

stop means movable between a blocking position permitting limited rotation of one group of jaws from said second position while blocking rotation of the other group of jaws to said second position during rotation of said final drive in one direction and a release position permitting said other group of jaws to rotate to said second position; and means for selectively moving said stop means between said blocking and release positions.

3. A kelly spinner comprising:

a housing;

an annular final drive gear having annular rack means in said housing;

means for rotating said final drive gear in opposite directions;

a pipe engaging assembly rotatable relative to said final drive gear;

said assembly including:

upper and lower rings positioned inwardly of said final drive gear and above and below said rack means, a plurality of circumferentially arranged jaws each having spaced pipe engaging faces and teeth meshing with said rack means providing two groups of pipe engaging faces, hinge pins for said jaws securing said rings to each other and positioning said jaw teeth in engagement with said rack means, the pipe engaging faces on said jaws alternately swinging between a first position in which said faces define a relatively large circle and a second position in which said faces define a relatively small circle upon rotation of said final drive gear in opposite directions;

friction means between between said assembly and housing resisting rotation of said assembly in said housing;

stop means movable between a blocking position permitting limited rotation of one group of jaws from said second position while blocking rotation of the other group of jaws to said second position during rotation of said final drive gear in one direction and a release position permitting said other group of jaws to rotate to said second position; and means for selectively moving said stop means between said blocking and release positions.

4. The kelly spinner of claim 1, 2 or 3 wherein: the stop means is carried by said assembly and is movable between a position blocking rotation of one jaw and a position permitting rotation of said one jaw.

5. The kelly spinner of claim 1, 2 or 3 wherein: the stop means is carried by said assembly and is movable between a position blocking rotation of one jaw and a position permitting rotation of said one jaw; and the means for moving the stop means is provided by:

Resilient means urging the stop means toward blocking position, a pivoted arm for moving the stop means to release position, and means carried by said housing extensible to engage said pivoted arm and move it to stop release position.

6. The kelly spinner of claim 1, 2 or 3 wherein:

the stop means is carried by said assembly and is movable between a position blocking rotation of one jaw and a position permitting rotation of said one jaw;

said one jaw when in said rotated position holding said stop means in release position; and the means for moving the stop means is provided by:

resilient means urging the stop means toward blocking position, a pivoted arm for moving the stop means to release position, and means carried by said housing and extensible to engage said pivoted arm and move it to stop release position.

* * * * *